US007329089B2

(12) United States Patent
Senba

(10) Patent No.: US 7,329,089 B2
(45) Date of Patent: Feb. 12, 2008

(54) CENTRIFUGAL FAN

(75) Inventor: Morio Senba, Kiryu (JP)

(73) Assignee: Japan Servo Co., Ltd., Tokyo-to (JP)

( * ) Notice: Subject to any disclaimer, the term of this patent is extended or adjusted under 35 U.S.C. 154(b) by 9 days.

(21) Appl. No.: 11/339,611

(22) Filed: Jan. 26, 2006

(65) Prior Publication Data

US 2006/0171803 A1 Aug. 3, 2006

(30) Foreign Application Priority Data

Jan. 28, 2005 (JP) ..... 2005-020809

(51) Int. Cl.
*F04D 29/48* (2006.01)

(52) U.S. Cl. ..... 415/146; 415/206; 415/211.2

(58) Field of Classification Search ..... 415/146, 415/206, 211.2, 213.1
See application file for complete search history.

(56) References Cited

U.S. PATENT DOCUMENTS 3,254,830 A * 6/1966 Wallin ..... 415/61
5,281,092 A * 1/1994 Sullivan ..... 415/206
6,899,516 B2 * 5/2005 Wang ..... 415/60
2005/0207888 A1 9/2005 Kashiwazaki et al.

FOREIGN PATENT DOCUMENTS

JP 2003-278697 10/2003

OTHER PUBLICATIONS

U.S. Appl. No. 11/339,611, filed Jan. 26, 2006, Senba.
U.S. Appl. No. 11/392,749, filed Mar. 30, 2006, Shimada.

* cited by examiner

*Primary Examiner*—Edward K. Look
*Assistant Examiner*—Nathan Wiehe
(74) *Attorney, Agent, or Firm*—Oblon, Spivak, McClelland, Maier & Neustadt, P.C.

(57) ABSTRACT

A centrifugal fan includes a scroll casing consisting of first and second flat base walls, a circumferential side wall. An air inlet is formed on the first base wall, an exhaust port is formed on the side wall. A backflow prevention mechanism is arranged in the airflow path to prevent backflow from the exhaust port during fan halting. The mechanism has a flap that is rotatably supported by the first base wall and its rotation axis is inclined with respect to the vertical direction so that the flap shuts the airflow path under its own weight in a horizontal-use position where the rotating shaft of the motor is horizontal. The flap is inserted into a slit from the outside and is held by a stopper plate. A protrusion, which contacts with the rim of the flap when the flap shuts the airflow path, is formed inside the walls.

8 Claims, 5 Drawing Sheets

CENTRIFUGAL FAN

BACKGROUND OF THE INVENTION

The present invention relates to a centrifugal fan that collects airflow taken in from an air inlet formed at the center of one flat base wall of a scroll casing and discharges the airflow from an exhaust port formed on a cylindrical side wall in a centrifugal direction. More particularly, the present invention relates to a mechanism to prevent backflow during fan halting.

Centrifugal fans, which use DC brushless motors especially, are widely used to cool electronic components of OA equipment such as a personal computer, a copying machine, a liquid crystal projector and a disk array because they can not only make the motors compact and light in weight but also control air quantity easily due to easy control of the motor. A plurality of centrifugal fans are used when a target device has a high heating value.

Some centrifugal fan shave backflow prevention mechanisms to prevent backflow from the exhaust port to the air inlet during fan halting due to faults of motors or driving circuits. For example, Japanese unexamined patent publication No. 2003-278697 (JP2003-278697A) discloses a centrifugal fan that has the backflow prevention mechanism.

The backflow prevention mechanism of the centrifugal fan disclosed in the publication is provided with a flat-shaped flap located in the airflow path to the exhaust port of the scroll casing to shut an airflow path during fan halting. The flap is rotatably supported at a base wall of the casing that becomes upper side in a vertical-use position where a rotating shaft of a fan motor is vertical. In the vertical-use position, the airflow pushes the flap to turn open and is discharged from the exhaust port during fan operating. When the fan stops, the flap turns to shut the airflow path under its own weight and prevents backflow.

However, since the centrifugal fan disclosed in the above-described publication is designed on the assumption that it would operate in the vertical-use position, the backflow prevention mechanism may not function when the fan is arranged so that the rotating shaft of the fan motor is horizontal due to limitations of space for example. That is, the rotation axis of the flap is almost perpendicular to the airflow discharging direction. This arrangement has an advantage in minimizing the flap area. However, when the centrifugal fan is arranged so that the rotation shaft of the fan motor is horizontal (a horizontal-use position) and the airflow discharging direction is also horizontal, the rotation axis of the flap becomes almost vertical, which disables the flap from closing by its own weight.

SUMMARY OF THE INVENTION

The purpose of the present invention is to solve the above-mentioned problem by providing an improved centrifugal fan in which the backflow prevention mechanism functions effectively not only in the vertical-use position but also in the horizontal-use position.

In order to accomplish the above-mentioned purpose, a centrifugal fan according to the present invention includes:

a scroll casing that has first and second flat base walls, a circumferential side wall covering the circumferences of the base walls, an air inlet that is opened in an axial direction being formed on a center portion of the first base wall, and an exhaust port that is opened in a circumferential direction being formed on one portion of the circumferential side wall;

a motor that is attached to a center portion of the second base wall at the inside of the casing so that a rotating shaft of the motor is perpendicular to the second base wall;

an impeller that is fixed to the rotating shaft, the impeller having many blades along the outer region thereof; and a backflow prevention mechanism that prevents backflow from the exhaust port during fan halting by shutting an airflow path to the exhaust port, wherein the backflow prevention mechanism has a flat-shaped flap that is rotatably supported by the first base wall so that one side touching to the first base wall is a rotation axis, and the rotation axis is inclined with respect to the vertical direction so that the flap shuts the airflow path under its own weight in a horizontal-use position where the rotating shaft of the motor is horizontal.

With this construction, since the rotation axis of the flap that constitutes the backflow prevention mechanism is inclined with respect to the vertical direction in the horizontal-use position, the flap shuts the airflow path under its own weight not only in the vertical-use position but also in the horizontal-use position during fan halting. Therefore, the backflow prevention mechanism functions effectively.

It is preferable that a linear slit into which the flap can be inserted from the outside of the casing is formed on the first base wall. This allows the flap to be attached after assembling the casing and therefore assembling work is easier than the case where the casing is assembled after attaching the flap.

Further, it is preferable that a cylindrical shaft portion is formed at the one side of the flap and guide portions for rotatably supporting the cylindrical shaft portion are formed at both ends of the slit of the first base wall. This allows the flap to turn smoothly.

Still further, the centrifugal fan is preferably provided with a stopper plate that has elastic leg portions each of which has a lug on its tip. In this case, small holes into which the leg portions are inserted are formed at both sides of the slit on the first base wall. When the leg portions are inserted into the small holes, the lugs are snapped with the first base wall and the stopper plate holds the flap inserted into the slit.

Yet further, a protrusion, which contacts with the rim of the flap when the flap shuts the airflow path, may be formed inside of each the wall that forms the airflow path. The protrusion increases air tightness during the flap shutting and prevents the backflow more efficiently.

The protrusion is preferably formed so that its upstream side of the air flow is an inclined surface that gradually narrows the airflow path and its downstream side is a sealing surface that is perpendicular to the wall to contact with the flap. The inclined surface does not prevent the airflow during fan operating and the sealing surface can hold air tightness during fan halting.

Further, a slope is preferably formed inside the wall that forms the airflow path at the side of the rotation axis under the flap in the horizontal-use position. When the flap opens due to a push by the discharged airflow, the lower edge of the flap runs onto the slope so that the flap is slightly displaced upward in the direction of the rotation axis. The slope ensures that the flap starts to turn for shutting the airflow path when the fan stops.

The flap maybe supported by both of a tip of a nose formed in the airflow path and a position opposite to the nose. This arrangement of the flap can decrease an area of the flap.

From a study of the balance between a performance of the centrifugal fan and the rotation of the flap under its own weight, it is confirmed that the weight of the flap should be equal to or lighter than 5 grams for actual use, when airflow performance is 0.5 through 2 $m^3$/min and the airflow path area at the flap position is about 30 $cm^2$.

DESCRIPTION OF THE ACCOMPANYING DRAWINGS

DESCRIPTION OF THE EMBODIMENTS

Hereinafter, an embodiment of a centrifugal fan according to the present invention will be described with reference to the drawings.

Figure 1:
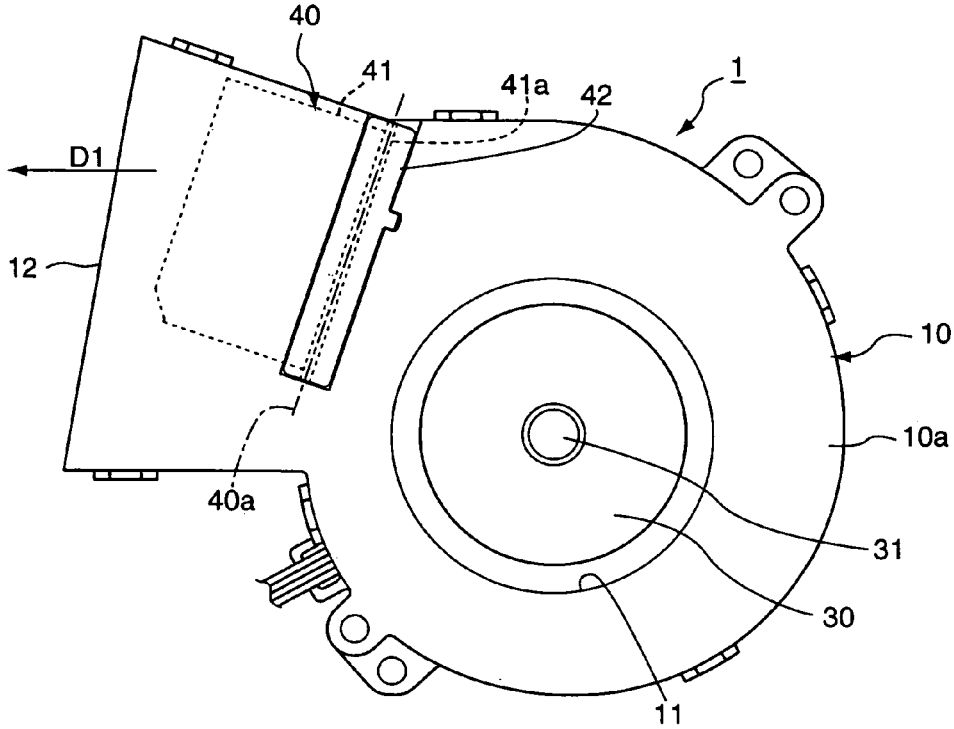
FIG. 1 is a front view of a centrifugal fan of an embodiment according to the present invention in the horizontal-use position during fan operating.
Figure 2:
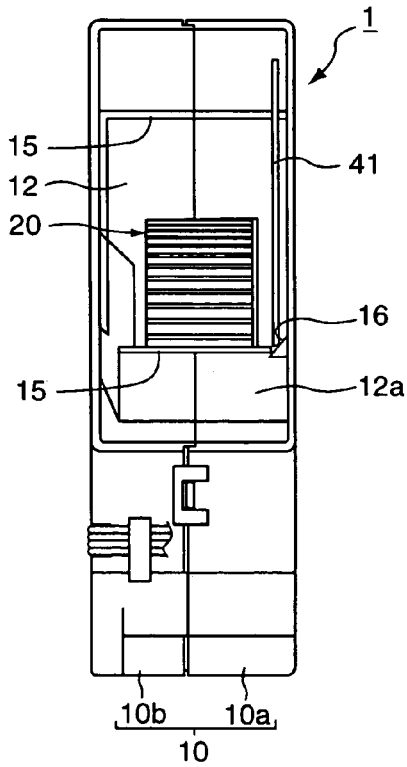
FIG. 2 is a side view of the centrifugal fan shown in FIG. 1 viewed from a side of an exhaust port during fan operating.

FIG. 1 is a front view of the centrifugal fan 1 of the embodiment according to the present invention in a horizontal-use position during fan operating, and FIG. 2 is a side view thereof viewed from a side of an exhaust port during fan operating. In addition, a horizontal-use position means that the centrifugal fan 1 is positioned so that a rotating shaft of the centrifugal fan 1 (a rotating shaft of a motor) is horizontal and a discharged direction of airflow becomes almost horizontal. Further, a vertical-use position means that the centrifugal fan 1 is positioned so that the rotating shaft of the centrifugal fan 1 is vertical.

The centrifugal fan 1 of the embodiment is, as shown in FIG. 1 and FIG. 2, provided with a scroll casing 10 having first and second flat base walls that are parallel to each other and a cylindrical circumferential side wall covering the circumferences of the base walls. The resin-made casing 10 consists of a first casing 10*a* and a second casing 10*b*. The first casing 10*a* constitutes the first base wall and a part of the circumferential side wall, and the second casing 10*b* constitutes the second base wall and the remaining part of the circumferential side wall. An air inlet 11 that is opened in an axial direction is formed on a center portion of the base wall portion of the first casing 10*a*, and an exhaust port 12 that is opened in a circumferential direction is formed on one position of the circumferential side wall (see FIG. 2).

Figure 3:
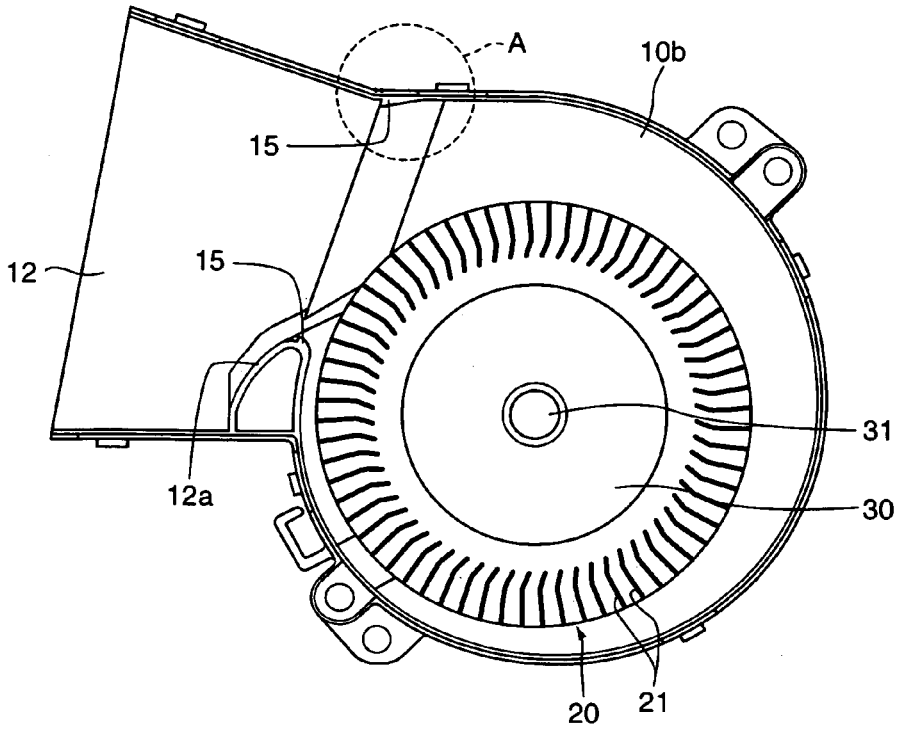
FIG. 3 is a front view of the centrifugal fan shown in FIG. 1 when a first casing is removed.

Inside the casing 10, as shown in FIG. 3 that shows the condition when the first casing 10*a* is removed, an impeller 20 having many blades 21 along the outer region thereof is rotatably mounted. The inner circumferential surface of the casing is formed like a scroll and the width of an airflow path, which is formed between the inner circumferential surface of the casing 10 and the outer circumference of the impeller 20, in the radial direction gradually increases from a nose 12*a* of the exhaust port 12 as a starting point in the rotating direction of the impeller 20 (the counterclockwise direction in FIG. 3).

A motor 30 that drives to rotate the impeller 20 is fixed to the center portion of the base wall of the second casing 10*b*. A rotating shaft 31 of the motor 30 is perpendicular to the base walls. The motor 30 is a DC brushless motor of an outer-rotor type. The impeller 20 is molded from resin to form a single-piece construction with a rotor of the motor 30 and thereby it is fixed to the rotating shaft 31 of the motor 30.

The centrifugal fan 1 of the embodiment includes a backflow prevention mechanism 40 that prevents backflow from the exhaust port 12 during fan halting by shutting an airflow path to the exhaust port 12. The backflow prevention mechanism 40 has a flat-shaped flap 41 that is rotatably supported by the base wall of the first casing 10*a* so that one side touching to the base wall is a rotation axis 40*a*. The flap 41 is supported by both of a tip of the nose 12*a* and a position opposite to the nose 12*a*. This arrangement of the flap 41 can decrease an area of the flap 41. The rotation axis 40*a* is, as shown in FIG. 1, inclined with respect to the vertical direction so that the flap 41 shuts the airflow path under its own weight in the horizontal-use position.

Figure 4:
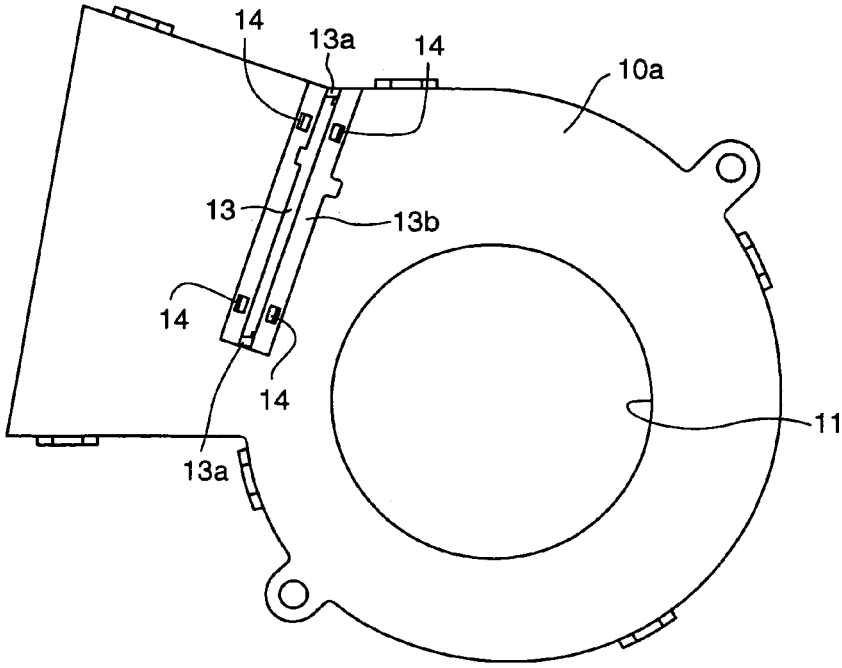
FIG. 4 is a front view of the first casing of the centrifugal fan shown in FIG. 1 viewed from the outside.
Figure 5:
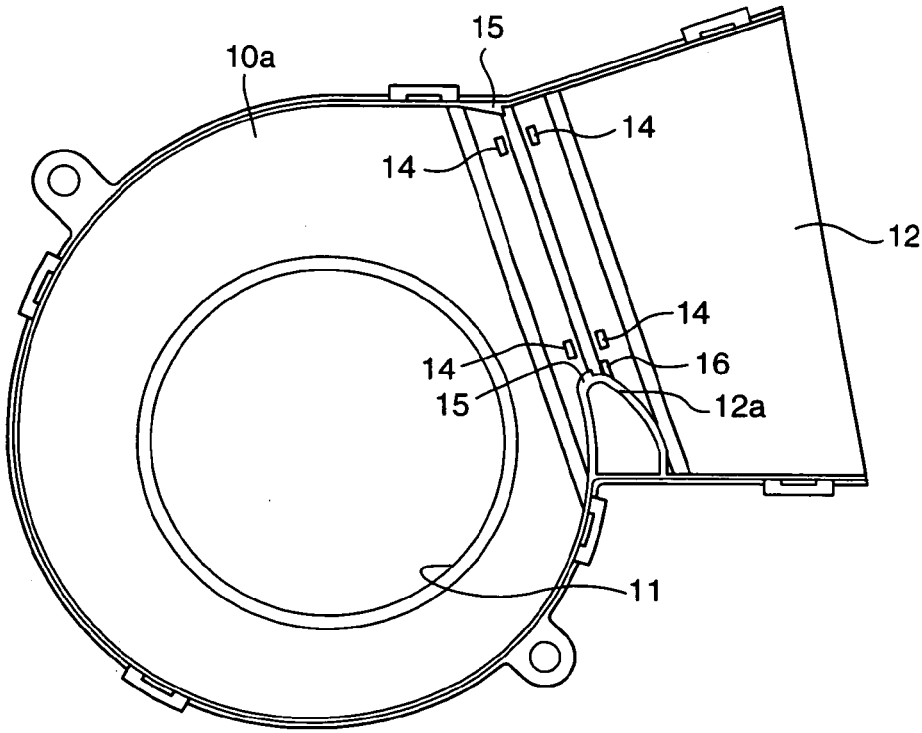
FIG. 5 is a back view of the first casing of the centrifugal fan shown in FIG. 1 viewed from the inside.

FIG. 4 is a front view of the first casing 10*a* of the centrifugal fan 1 shown in FIG. 1 viewed from the outside, and FIG. 5 is a back view thereof viewed from the inside. As shown in FIG. 4 and FIG. 5, a linear slit 13 into which the flap 41 can be inserted from the outside of the casing 10 is formed on the base wall of the first casing 10*a*. Two pairs of small rectangular holes 14 are formed at the both sides of the slit 13.

Figure 6:
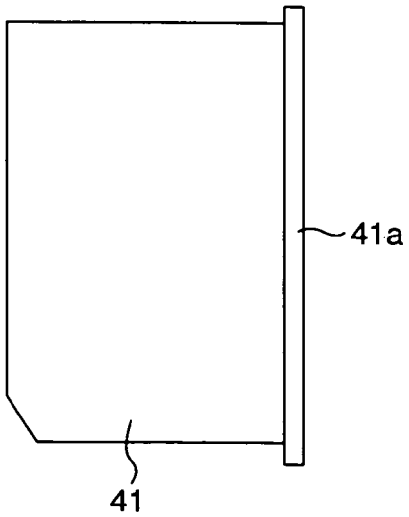
FIG. 6 is a plane view of a flap of the centrifugal fan shown in FIG. 1.

On the other hand, the flap 41 is a rectangular plate as shown in FIG. 6, and a cylindrical shaft portions 41*a* is formed at the one side of the flap 41. The center axis of the shaft portion 41*a* is coincident with the rotation axis 40*a*. And then, cylindrical guide portions 13*a* for rotatably supporting the cylindrical shaft portion 41*a* are formed at both ends of the slit 13 of the first casing 10*a*.

Figure 7A:
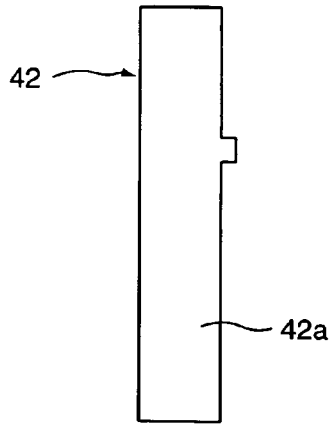
FIG. 7A is a plane view of a stopper plate of the centrifugal fun shown in FIG. 1.
Figure 7B:
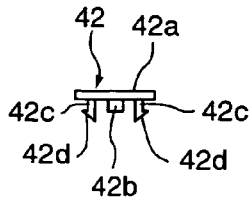
FIG. 7B is a side view of the stopper plate of the centrifugal fun shown in FIG. 1 viewed from a short side thereof.
Figure 7C:
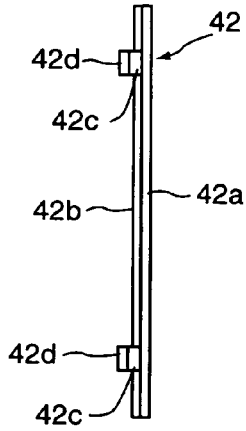
FIG. 7C is a side view of the stopper plate of the centrifugal fun shown in FIG. 1 viewed from a long side thereof.

Further, the backflow prevention mechanism 40 is provided with a stopper plate. 42 (see FIG. 1) that holds the flap 41 inserted into the slit 13. FIGS. 7A, 7B and 7C show the construction of the stopper plate 42; FIG. 7A is a plane view, FIG. 7B is a side view viewed from a short side and FIG. 7C is a side view viewed from the long side. As shown in these drawings, the stopper plate 42 includes a flat and rectangular plate portion 42*a*, a holding projection 42*b* that is formed on the back surface of the plate portion 42*a* in a direction of the long side thereof, and two pairs of leg portions 42*c* that are formed at the both sides of the holding projection 42*b*. The leg portions 42*c* are elastic and a lug 42*d* is formed on the tip of each of the leg portions 42*c*.

On the other hand, a depressed portion 13*b* to which the plate portion 42*a* of the stopper plate 42 is fitted is formed on the first casing 10*a* around the slit 13 (see FIG. 4).

When the backflow prevention mechanism 40 is assembled, the flap 41 is inserted into the slit 13 after the first casing 10*a* and the second casing 10*b* are combined with the motor 30, the impeller 20 and the like. At this time, the shaft portion 41*a* of the flap 41 contacts with the guide portions 13*a*. Then, the stopper plate 42 is pushed to the first casing 10*a* with the leg portions 42*c* are positioned to the small holes 13 of the first casing 10*a*. As a result, the leg portions 42*c* are inserted into the small holes 14. When the stopper plate 42 is pushed to the predetermined position, the leg portions 41*c* come through the small holes 14 and the lugs 41*d* of the leg portions 41*c* hook the base wall of the first casing 10*a* from the back side, which fixes the stopper plate 42 to the first casing 10*a*. Further, the holding projection 42*b* of the stopper plate 42 is fitted in the slit 13 to hold the cylindrical shaft portion 41*a* of the flap 41. Still further, the plate portion 42*a* of the stopper plate 42 is fitted into the depressed portion 13*b*, and the stopper plate 42 forms the same continuous surface as the surrounding surface of the first casing 10*a*.

Since the flap 41 can be attached after assembling the casing 10, assembling work is easier than the case where the casing 10 is assembled after attaching the flap 41. Further, since the shaft portion 41*a* formed at one side of the flap 41 is supported by the guide portions 13*a* formed on the first casing 10*a* and is held by the holding projection 42*b* of the stopper plate 42, the flap 41 can turn smoothly.

Figure 8:
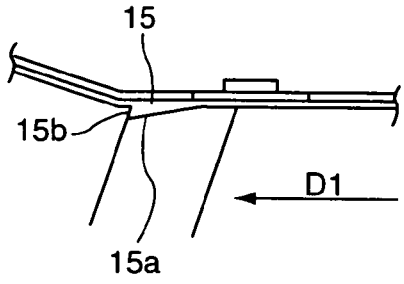
FIG. 8 is an enlarged view of the portion in a circle shown by a dotted line in FIG. 3.

In addition, as shown in FIG. 2, FIG. 3 and FIG. 5, a protrusion 15, which contacts with the rim of three sides of the flap 41 except the side of the shaft portion 41*a* when the flap 41 shuts the airflow path, is formed inside the walls that form the airflow path. That is, the protrusion 15 is formed inside the side wall, the nose 12*a* and the base wall of the second casing 10*b*. It is not formed inside the base wall of the first casing 10*a*. FIG. 8 is an enlarged view of the portion in a circle shown by a dotted line in FIG. 3. As shown in FIG. 8, the protrusion 15 is formed so that its upstream side of the airflow (the discharging direction D1) is an inclined surface 15*a* that gradually narrows the airflow path and its downstream side is a sealing surface 15*b* that is perpendicular to the wall to contact with the flap 41. The protrusion 15 increases airtightness during the flap shutting and prevents the backflow more efficiently. Moreover, the inclined surface 15*a* does not prevent the airflow during fan operating and the sealing surface 15*b* can hold airtightness during fan halting.

Figure 9:
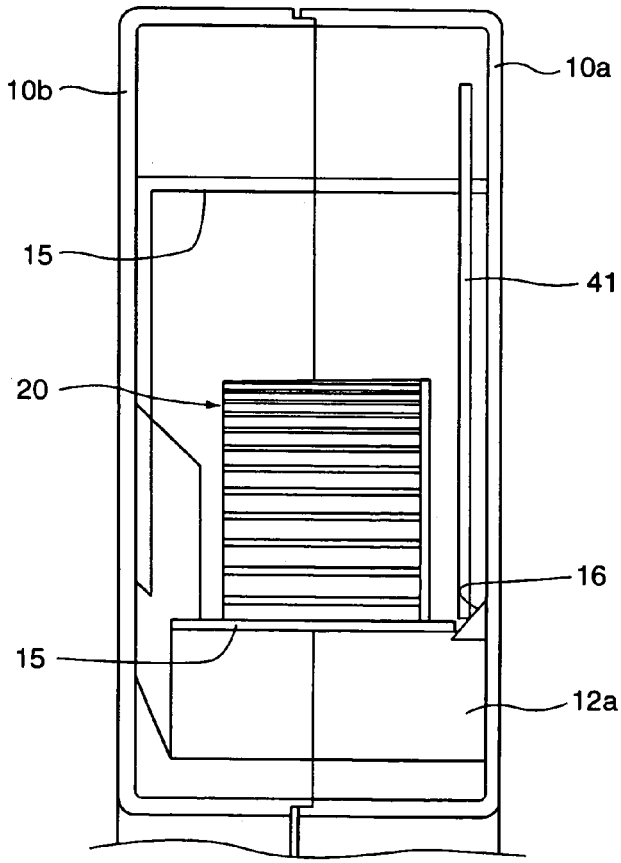
FIG. 9 is an enlarged view of a principal portion (the inside of the exhaust port) of the centrifugal fan shown in FIG. 1.

Still further, as shown in FIG. 2, FIG. 6 and FIG. 9 that is an enlarged view of the principle portion of the exhaust port in FIG. 2, a slope 16 is formed from the base wall to the side wall at the side of the rotation axis 40*a* under the flap 41 in the horizontal-use position. That is, the slope 16 is formed at the downstream of the slit 13 of the first casing 10*a*. When the flap 41 opens due to a push by the discharged airflow, the lower edge of the flap 41 runs onto the slope 16 so that the flap 41 is slightly displaced upward in the direction of the rotation axis 40*a*. Since the slope 16 generates a moment in a closing direction by gravitation that acts on the flap 41 when the fan stops, the slope 16 ensures that the flap 41 starts to turn for shutting the airflow path.

From a study of the balance between a performance of the centrifugal fan 1 and the rotation of the flap 41 under its own weight, it is confirmed that the weight of the flap 41 should be equal to or lighter than 5 grams for actual use, when airflow performance is 0.5 through 2 $m^3$/min and the airflow path area at the flap position is about 30 $cm^2$.

Next, a function of the centrifugal fan 1 as mentioned above will be described.

Figure 10:
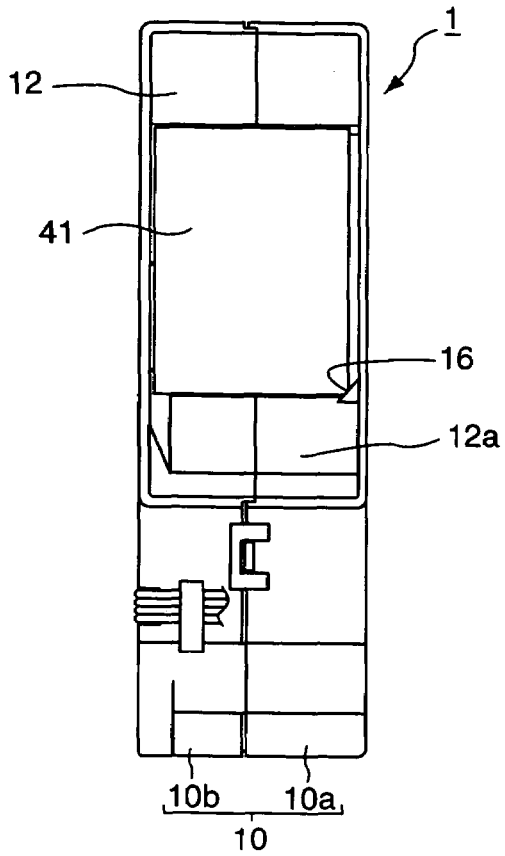
FIG. 10 is a side view of the centrifugal fan shown in FIG. 1 viewed from the side of the exhaust port during fan halting.

In the horizontal-use position, the flap 41 turns open due to a push by the discharged airflow as shown in FIG. 1 and FIG. 2 during fan operating, and then the airflow path is formed. When the flap 41 opens, the lower edge of the flap 41 runs onto the slope 16, the flap 41 is slightly displaced upward in the direction of the rotation axis 40*a*. When the fan stops, the force in the downward direction acts on the flap 41 by gravitation. The force in the downward direction is converted into that in the lateral direction by the slope 16. Therefore, the force to close the flap 41 acts on the flap 41. After the flap 41 turns in slight angle, the rotation force is generated by the flap's weight and the flap 41 turns until it contacts the protrusion 15. When the flap 41 contacts the protrusion 15, as shown in FIG. 10, the flap 41 shuts the airflow path to the exhaust port 12, which prevent the backflow from the exhaust port 12.

Figure 11:
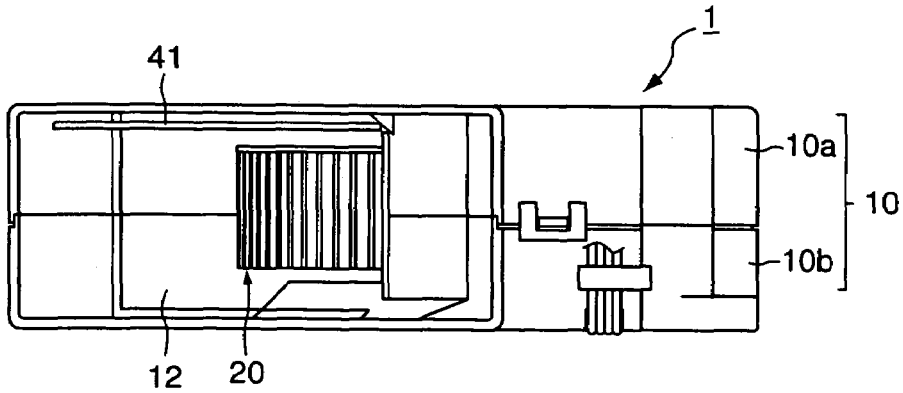
FIG. 11 is a side view of the centrifugal fan shown in FIG. 1 at a vertical-use position viewed from the side of the exhaust port during fan operating.

On the other hand, in the vertical-use position, as shown in FIG. 11, the centrifugal fan 1 is arranged so that the first casing 10*a* becomes upside. In such an arrangement, the rotation axis 40*a* of the flap 41 is horizontal. When the fan operates, as shown in FIG. 11, the flap 41 turns to be lifted up due to a push by the discharged airflow, and then the airflow path is formed. When the fan stops, the flap 41 turns to close under its own weight and shuts the airflow path.

As described above, according to the construction of the embodiment, since the rotation axis of the flap 41 that constitutes the backflow prevention mechanism 40 is inclined with respect to the vertical direction in the horizontal-use position, the flap 41 shuts the airflow path under its own weight not only in the vertical-use position but also in the horizontal-use position during fan halting. Therefore, the backflow prevention mechanism 40 functions effectively.

What is claimed is:

1. A centrifugal fan comprising:

a scroll casing that has first and second flat base walls, a circumferential side wall covering the circumferences of said base walls, an air inlet that is opened in an axial direction being formed on a center portion of said first base wall and an exhaust port that is opened in a circumferential direction being formed on one portion of said circumferential side wall;

a motor that is attached to a center portion of said second base wall at an inside of said casing so that a rotating shaft of the motor is perpendicular to said second base wall;

an impeller that is fixed to said rotating shaft, the impeller having many blades along an outer region thereof; and a backflow prevention mechanism that prevents backflow from said exhaust port during fan halting by shutting an airflow path to said exhaust port, wherein said backflow prevention mechanism has a flat-shaped flap that is rotatably supported by said first base wall so that one side touching to said first base wall is a rotation axis, and the rotation axis is inclined with respect to the vertical direction so that the flap shuts the airflow path under its own weight in a horizontal-use position where the rotating shaft of said motor is horizontal, and a slope member, onto which the lower edge of said flap runs when said flap opens due to a push by the discharged airflow so that said flap is slightly displaced upward in the direction of the rotation axis, is formed inside the walls that form the airflow path at a side of the rotation axis under said flap in the horizontal-use position.

2. The centrifugal fan according to claim 1, wherein a linear slit into which said flap can be inserted from an outside of said casing is formed on said first base wall.

3. The centrifugal fan according to claim 2, wherein a cylindrical shaft portion is formed at the one side of said flap and guide portions for rotatably supporting said cylindrical shaft portion are formed at both ends of said slit of said first base wall.

4. The centrifugal fan according to claim 3, further comprising a stopper plate that has elastic leg portions each of which has a lug on its tip, and wherein small holes into which said leg portions are inserted are formed at both sides of said slit on said first base wall so that said flap inserted into said slit is held by said stopper plate when said leg portions are inserted into said small holes and said lugs are snapped with the first base wall.

5. The centrifugal fan according to claim 1, wherein a protrusion, which contacts with a rim of said flap when said flap shuts the airflow path, is formed inside of each of the walls that form the airflow path.

6. The centrifugal fan according to claim 5, wherein said protrusion is formed so that its upstream side in an airflow direction is an inclined surface that gradually narrows the airflow path and its downstream side is a sealing surface that is perpendicular to the walls to contact with said flap.

7. The centrifugal fan according to claim 1, wherein said flap is supported by a tip of a nose formed in the airflow path and a position opposite to said nose.

8. The centrifugal fan according to claim 1, wherein a weight of said flap is equal to or lighter than 5 grams when airflow performance is 0.5 through 2 $m^3$/min and an airflow path area at a flap position is about 30 $cm^2$.

* * * * *